US009373332B2

(12) United States Patent
Oshikiri et al.

(10) Patent No.: US 9,373,332 B2
(45) Date of Patent: Jun. 21, 2016

(54) CODING DEVICE, DECODING DEVICE, AND METHODS THEREOF

(75) Inventors: Masahiro Oshikiri, Kanagawa (JP); Takako Hori, Kanagawa (JP); Hiroyuki Ehara, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 428 days.

(21) Appl. No.: 13/814,597

(22) PCT Filed: Nov. 8, 2011

(86) PCT No.: PCT/JP2011/006236

§ 371 (c)(1),
(2), (4) Date: Feb. 6, 2013

(87) PCT Pub. No.: WO2012/081166

PCT Pub. Date: Jun. 21, 2012

(65) Prior Publication Data

US 2013/0132099 A1 May 23, 2013

(30) Foreign Application Priority Data

Dec. 14, 2010 (JP) ..... 2010-278228
Apr. 6, 2011 (JP) ..... 2011-084440

(51) Int. Cl.
*G10L 19/00* (2013.01)
*G10L 19/008* (2013.01)
(Continued)

(52) U.S. Cl.
CPC ..... *G10L 19/008* (2013.01); *G10L 19/22* (2013.01); *G10L 19/24* (2013.01); *G10L 21/038* (2013.01)

(58) Field of Classification Search
USPC ..... 704/500, 501, 502
See application file for complete search history.

(56) References Cited

U.S. PATENT DOCUMENTS 3,700,820 A * 10/1972 Blasbalg ..... G06F 3/00 370/468
5,742,734 A * 4/1998 DeJaco et al. ..... 704/226
(Continued)

FOREIGN PATENT DOCUMENTS

CN 1247415 3/2000
CN 1945695 4/2007
(Continued)

OTHER PUBLICATIONS

J.Sjoberg et al., "RTP Payload Format and File Storage Format for the Adaptive Multi-Rate (AMR) and Adaptive Multi-Rate Wideband (AMR-WB) Audio Codecs", IETF RFC4867, Apr. 2007, pp. 1-44.
(Continued)

*Primary Examiner* — Vu B Hang
(74) *Attorney, Agent, or Firm* — Greenblum & Bernstein, P.L.C.

(57) ABSTRACT

Provided are a coding device, a decoding device, and methods thereof, with which it is possible to implement high sound quality coding and decoding in layered coding (scalable coding or embedded coding) wherein each layer comprises a plurality of bit rates (multi-rate). In the coding device (100), a feature analysis unit (101) extracts feature values of an input signal. Then a bit rate determination unit (102) determines, on the basis of the feature values of the input signal, a combination of a coding rate (low region coding rate) of a low region signal coding unit (104) which carries out coding of a low region part of the input signal and a coding rate (high region coding rate) of a high region signal coding unit (105) which carries out coding of a high region part of the input signal.

12 Claims, 14 Drawing Sheets

(51) Int. Cl.

| | |
|---|---|
| ***G10L 19/22*** | (2013.01) |
| *G10L 21/038* | (2013.01) |
| *G10L 19/24* | (2013.01) |

(56) References Cited

U.S. PATENT DOCUMENTS

| | | | | |
|---|---|---|---|---|
| 6,393,393 | B1 | 5/2002 | Kawahara | |
| 6,697,775 | B2 | 2/2004 | Kawahara | |
| 8,422,569 | B2 | 4/2013 | Yamanashi et al. | |
| 2002/0138259 | A1 | 9/2002 | Kawahara | |
| 2005/0254588 | A1 | 11/2005 | Kim et al. | |
| 2007/0078646 | A1 | 4/2007 | Lei et al. | |
| 2007/0094027 | A1 | 4/2007 | Vasilache | |
| 2007/0094035 | A1 | 4/2007 | Vasilache | |
| 2009/0210234 | A1 * | 8/2009 | Sung et al. | 704/500 |
| 2010/0235720 | A1 * | 9/2010 | Miki | H03M 13/2963 714/786 |
| 2010/0280833 | A1 | 11/2010 | Yamanashi et al. | |
| 2012/0065984 | A1 | 3/2012 | Yamanashi et al. | |

FOREIGN PATENT DOCUMENTS

| | | |
|---|---|---|
| CN | 101197576 | 6/2008 |
| JP | 9-504124 | 4/1997 |
| JP | 2001-267928 | 9/2001 |
| JP | 2005-215502 | 8/2005 |
| JP | 2005-328542 | 11/2005 |
| JP | 2009-288560 | 12/2009 |
| WO | 2007/046027 | 4/2007 |

OTHER PUBLICATIONS

"AMR Wideband Speech Codec; Frame Structure (Release 5)", 3GPP TS 26.201, Mar. 2001, pp. 1-22.

"Recommendation Amendment 2: New Annex B on superwideband scalable extension for ITU-T G.718 and corrections to main body fixed-point C-code and description text", ITU-T G.718, Mar. 2010, pp. 1-51.

H. Schulzrinne et al., "RTP: A Transport Protocol for Real-Time Applications", IETF RFC3550, Jul. 2003, pp. 1-77.

English translation of China Search Report, dated Feb. 18, 2014.

* cited by examiner

| BIT RATE MODE | LOW-REGION ENCODING RATE | HIGH-REGION ENCODING RATE |
|---|---|---|
| 28kbit/s MODE | 24kbit/s | 4kbit/s |
| 32kbit/s MODE | 24kbit/s | 8kbit/s |
| 36kbit/s MODE | 32kbit/s | 4kbit/s |
| 40kbit/s MODE | 24kbit/s | 16kbit/s |
| | 32kbit/s | 8kbit/s |
| 48kbit/s MODE | 32kbit/s | 16kbit/s |

FIG.1

CMR : CODEC MODE REQUEST INFORMATION TO OPPOSING TERMINAL(Codec Mode Request)
F : FLAG INDICATING WHETHER PAYLOAD WILL CONTINUE
FT : BIT RATE INFORMATION (FRAME TYPE)
Q : ERROR DETECTION FLAG (FRAME QUALITY INDICATOR)

| BIT RATE MODE | LOW-REGION ENCODING RATE | HIGH-REGION ENCODING RATE | BIT RATE INFORMATION | PAYLOAD DATA PART SIZE |
|---|---|---|---|---|
| 28kbit/s MODE | 24kbit/s | 4kbit/s | 0 | 560bit |
| 32kbit/s MODE | 24kbit/s | 8kbit/s | 1 | 640bit |
| 36kbit/s MODE | 32kbit/s | 4kbit/s | 2 | 720bit |
| 40kbit/s MODE | 24kbit/s | 16kbit/s | 3 | 800bit |
| | 32kbit/s | 8kbit/s | | |
| 48kbit/s MODE | 32kbit/s | 16kbit/s | 4 | 960bit |

FIG.4

| | | LOW-REGION ENCODING RATE [kbit/s] | | | | | | |
|---|---|---|---|---|---|---|---|---|
| | | 8 | 10 | 12 | 14 | 16 | 18 | 20 |
| HIGH-REGION ENCODING RATE [kbit/s] | 4 | 12 | 14 | 16 | 18 | 20 | 22 | 24 |
| | 6 | 14 | 16 | 18 | 20 | 22 | 24 | 26 |
| | 8 | 16 | 18 | 20 | 22 | 24 | 26 | 28 |
| | 10 | 18 | 20 | 22 | 24 | 26 | 28 | 30 |
| | 12 | 20 | 22 | 24 | 26 | 28 | 30 | 32 |
| | 14 | 22 | 24 | 26 | 28 | 30 | 32 | 34 |
| | 16 | 24 | 26 | 28 | 30 | 32 | 34 | 36 |

FIG.14

CODING DEVICE, DECODING DEVICE, AND METHODS THEREOF

TECHNICAL FIELD

The present invention relates to an encoding apparatus and decoding apparatus that encode and decode a speech signal and/or a music signal, and to methods thereof.

BACKGROUND ART

Art for encoding a speech signal that is compressed with a low bit rate is important for the effective use of radio waves and the like in mobile communications. In recent years, increasing demands have been placed on speech quality, and there has been a desire to achieve a telephone service having a wide signal bandwidth and a good realistic effect.

The G726 and G729 standards, established by the ITU-T (International Telecommunication Union Telecommunication Standardization Sector) exist as speech signal encoding systems. These systems handle narrowband (300 Hz to 3.4 kHz) signals (hereinafter referred to as NB signals), and perform encoding at a bit rate from 8 kbit/s to 32 kbit/s. Because the narrowband signals that are handled have a maximum frequency bandwidth of 3.4 kHz, although there is no problem with intelligibility, the sound quality is muffled and lacking in realistic effect.

ITU-T and 3GPP (The 3rd Generation Partnership Project) have standard systems (for example, G.722 and AMR-WB) which encode a wideband signal (hereinafter referred to as a WB signal) having a signal bandwidth of 50 Hz to 7 kHz. These systems have a bit rate of 6.6 kbit/s to 64 kbit/s, and can encode a wideband signal. Although compared with a narrowband signal, a wideband signal has better sound quality; it is still not a sufficient sound quality for a telephone service that demands a highly realistic effect.

In contrast, although conventional circuit switching systems have achieved speech communication, because they occupied a circuit, they have been inefficient. For this reason, there have appeared systems that seek to use a communication path effectively by packetizing encoded data and transmitting the data using an IP (Internet Protocol) network. In particular systems that apply this art to speech communications are called VoIP (Voice over IP) systems. In mobile communications, VoIP is used in, for example, the 3GPP LTE (Long-Term Evolution) communication system.

For example, in the case of applying AMR-WB to VoIP, the AMR-WB encoded data is transmitted on the IP network as a RTP (real-time transport protocol) packet payload. When this is done, the size of the payload is described as bit rate information in the FT (Frame Type) field of the header that is a part of the RTP payload. The header of the RTP payload is set forth in Non-Patent Literature 1 and Non-Patent Literature 2.

Some systems have been proposed to achieve speech communication with a highly realistic effect by encoding a superwideband (50 Hz to 14 kHz) signal (hereinafter referred to as an SWB signal). For example, the G.718 Annex B (Non-Patent Literature 3, hereinafter referred to as G.718B) system established as a standard by the ITU-T can encode an SWB signal at a bit rate of 28 kbit/s to 48 kbit/s. The G.718B has a layered structure including a plurality of layers, and can encode a low-region signal (50 Hz to 7 kHz) at the two bit rates of 24 kbit/s or 32 kbit/s, and can encode a high-region signal (7 kHz to 14 kHz) at the three bit rates of 4 kbit/s, 8 kbit/s, and 16 kbit/s.

FIG. 1 is a drawing that shows the correspondence between the bit rate modes that can be used in the case of G.718B and the combinations of the low-region bit rate (hereinafter referred to as the low-region encoding rate) and the high-region bit rate (hereinafter referred to as the high-region encoding rate). As shown in FIG. 1, G.718B can encode an SWB signal with any of the bit rate modes of the five bit rate modes.

CITATION LIST

Non-Patent Literature

NPL 1
IETF RFC 4867, "RTP Payload Format and File Storage Format for the Adaptive Multi-Rate (AMR) and Adaptive Multi-Rate Wideband (AMR-WB) Audio Codecs", April 2007.
NPL 2
3GPP TS 26.201, "AMR Wideband Speech Codec; Frame Structure", March 2001.
NPL 3
Recommendation ITU-T G.718 Amendment 2, "New Annex B on superwideband scalable extension for ITU-T G.718 and corrections to main body fixed-point C-code and description text", March 2010.
NPL 4
IETF RFC 3550, "RTP: A Transport Protocol for Real-Time Applications", July 2003.

SUMMARY OF INVENTION

Technical Problem

As in G.718B, if an encoding system has both a plurality of low-region encoding rates and a plurality of high-region encoding rates, the number of overall bit rates is the number of combinations of the low-region encoding rates and the high-region encoding rates. For this reason, there is the problem that, if an attempt is made to reserve a region in the FT field of the RTP payload header to enable representation of all the combinations of the low-region encoding rates and high-region encoding rates, the size of the header becomes large, and efficient communication is impossible.

A method that can be envisioned for suppressing an increase in the size of the header is that of imposing a restriction to one combination of the low-region encoding rate and the high-region encoding rate at which the overall bit rate (hereinafter referred to as the total encoding bit rate) is the same. However, there is the problem that, although the optimum combination can vary depending upon the input signal feature, the restriction to one combination prevents efficient encoding.

Taking G.718B as an example, when the overall bit rate (total encoding rate) is set to 40 kbit/s, there are two combinations of low-region encoding rate and high-region encoding rate, these being (24 kbit/s, 16 kbit/s) and (32 kbit/s, 8 kbit/s). Which combination is better should be basically determined in units of packets, (frames), depending upon the input signal feature. However, if a setting is made beforehand to either (24 kbit/s, 16 kbit/s) or (32 kbit/s, 8 kbit/s) in order to avoid an increase in the FT field size and notification is made of only the overall bit rate, there is the problem of not being able to sufficiently exploit the intrinsic performance of the codec.

An object of the present invention is to provide, in layer coding (scalable encoding, embedded encoding) in which each layer has a plurality of bit rates (multi-rate), an encoding apparatus, a decoding apparatus, and methods thereof that, in response to the input signal feature, determine the combinations of bit rates for each layer, so as to achieve encoding and decoding with high sound quality.

Solution to Problem

The encoding apparatus of the present invention has an analyzing section that analyzes an input signal feature for each of a low-region part and a high-region part of the input signal and that generates feature data that indicates the analysis results; a determining section that, based on a pre-set total encoding rate that is the total of a low-region encoding rate and a high-region encoding rate, and on the feature data, determines a combination of the low-region encoding rate and the high-region encoding rate; a low-region encoding section that encodes the low-region part of the input signal using the determined low-region encoding rate and generates low-region encoded data; a high-region encoding section that encodes the high-region part of the input signal using the determined high-region encoding rate and generates high-region encoded data; and a multiplexing section that multiplexes the low-region encoded data, the high-region encoded data, and the feature data.

The decoding apparatus of the present invention has a demultiplexing section that demultiplexes multiplexed data, in which low-region encoded data generated by encoding a low-region part of an input signal using a low-region encoding rate, high-region encoded data generated by encoding a high-region part of the input signal using a high-region encoding rate, and feature data indicating the results of analysis of the input signal feature for each of the low-region part and the high-region part are multiplexed, into the low-region encoded data, the high-region encoded data, and the feature data; a determining section that determines, based on a pre-set total encoding rate that is the total of the low-region encoding rate and the high-region encoding rate and on the feature data, a combination of the low-region encoding rate and the high-region encoding rate; a low-region decoding section that decodes the low-region encoded data using the determined low-region encoding rate; and a high-region decoding section that decodes the high-region encoded data using the determined high-region encoding rate.

A method for encoding of the present invention has: a step of analyzing an input signal feature for each of a low-region part and a high-region part of the input signal and generating feature data indicating the results of the analysis; a step of, based on a pre-set total encoding rate that is the total of a low-region encoding rate and a high-region encoding rate, and on the feature data, determining a combination of the low-region encoding rate and the high-region encoding rate; a step of encoding the low-region part of the input signal using the determined low-region encoding rate and generating low-region encoded data; a step of encoding the high-region part of the input signal using the determined high-region encoding rate and generating high-region encoded data; and a step of multiplexing the low-region encoded data, the high-region encoded data, and the feature data.

A method for decoding of the present invention has a step of demultiplexing multiplexed data, in which low-region encoded data generated by encoding a low-region part of an input signal using a low-region encoding rate, high-region encoded data generated by encoding a high-region part of the input signal using a high-region encoding rate, and feature data indicating the results of analysis of the input signal feature for each of the low-region part and the high-region part are multiplexed, into the low-region encoded data, the high-region encoded data, and the feature data; a step of, based on a pre-set total encoding rate that is the total of the low-region encoding rate and the high-region encoding rate and on the feature data, determining a combination of the low-region encoding rate and the high-region encoding rate; a step of decoding the low-region encoded data using the determined low-region encoding rate; and a step of decoding the high-region encoded data using the determined high-region encoding rate.

Advantageous Effects of Invention

According to the present invention, by determining the combination of bit rates of each layer in accordance with the input signal feature in layer coding (scalable encoding, embedded encoding) in which each layer has a plurality of bit rates (multi-rate), it is possible to achieve encoding and decoding with high sound quality.

BRIEF DESCRIPTION OF DRAWINGS

FIG. 1 is a table that shows the relationship of correspondence between the bit rate mode and the combination of the low-region encoding rate and the high-region encoding rate;

FIG. 4 is a table showing the relationship of correspondence between the bit rate mode, the bit rate information, and the payload size;

FIG. 14 is a table showing specific examples of combinations of the low-region encoding rate and the high-region encoding rate.

DESCRIPTION OF EMBODIMENTS

Embodiments of the present invention will be described in detail, with references made to the accompanying drawings.

In these embodiments, G.718B, which is a speech encoding system of an ITU-T standard for encoding an SWB (50 Hz to 14 kHz) signal, is used as an example.

G.718B encodes the low-region part (50 Hz to 7 kHz) of an SWB signal at the two bit rates of 24 kbit/s and 32 kbit/s, and encodes the high-region part (7 kHz to 14 kHz) of an SWB signal at the three bit rates of 4 kbit/s, 8 kbit/s, and 16 kbit/s.

As shown in FIG. 1, G.718B can encode an SWB signal at any bit rate mode selected from five bit rate modes.

When this is done, the 28-kbit/s mode is the minimum bit rate mode that guarantees a minimum quality, and the 48-kbit/s mode is the maximum bit rate mode that obtains the maximum quality. The other modes are intermediate bit rate modes. What mode will be used is pre-determined on the basis of an indicator such as the condition of the network. One example of the network condition is the degree of congestion. For example, when the network is free, the maximum bit rate mode is selected, when congestion occurs on the network, the minimum bit rate mode is selected, and in intermediate conditions, an intermediate bit rate is selected. In this manner, the bit rate mode of the encoding section is selected in accordance with the degree of network congestion.

An encoding apparatus according to the present invention will first be described with reference to FIG. 2.

Figure 2:
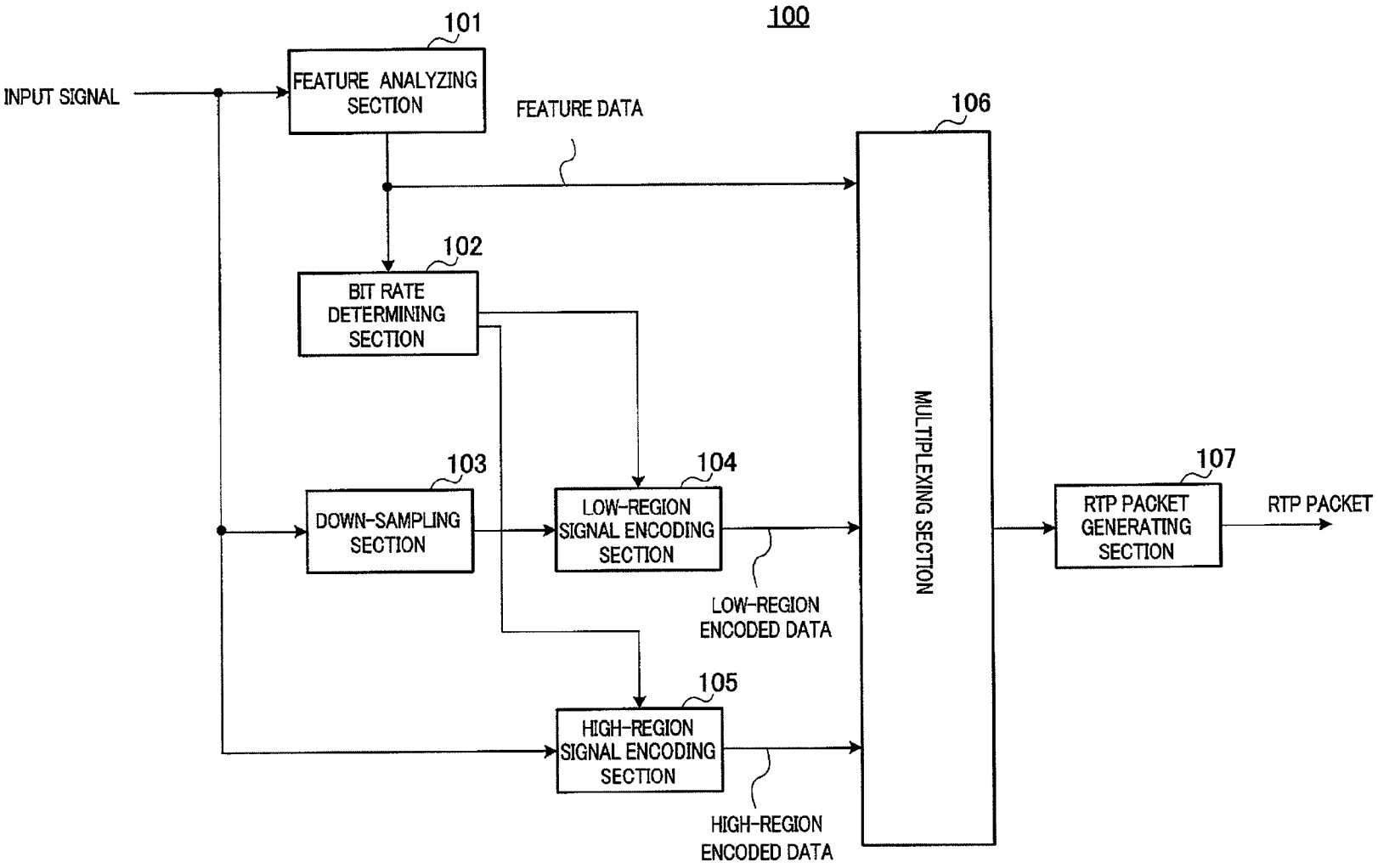
FIG. 2 is a block diagram showing the constitution of an encoding apparatus according to Embodiment 1 of the present invention.

FIG. 2 is a block diagram showing the constitution of the encoding apparatus according to the present embodiment. Encoding apparatus 100 in FIG. 2 performs encoding processing in units of a prescribed time interval (frame length), generates RTP packets, and transmits the RTP packets to a later-described decoding apparatus. In the description of the present embodiment, the frame length of 20 ms will be described as an example.

Encoding apparatus 100 of FIG. 2 has feature analyzing section 101, bit rate determining section 102, down-sampling section 103, low-region signal encoding section 104, high-region signal encoding section 105, multiplexing section 106, and RTP packet generating section 107.

Encoding apparatus 100 receives an SWB signal (for example, with a sampling rate of 32 kHz) as an input signal, and the input signal is applied to feature analyzing section 101, down-sampling section 103, and high-region signal encoding section 105.

Feature analyzing section 101 analyzes the input signal feature to generate feature data, and applies the feature data to bit rate determining section 102 and multiplexing section 106. Details of feature analyzing section 101 will be described later.

Based on the feature data, bit rate determining section 102 determines the encoding bit rate of low-region signal encoding section 104 (low-region encoding rate) and encoding bit rate of high-region signal encoding section 105 (high-region encoding rate). Bit rate determining section 102 also notifies low-region signal encoding section 104 of low-region encoding rate information and notifies high-region signal encoding section 105 of the high-region encoding rate information. Details of bit rate determining section 102 will be described later.

Down-sampling section 103 down-samples the input signal to generate a WB signal (for example, with a sampling rate of 16 kHz). The WB signal is applied to low-region signal encoding section 104.

Low-region signal encoding section 104 encodes the low-region part (low-region spectrum part) of the input signal based on the low-region encoding rate determined by bit rate determining section 102 to generate low-region encoded data. The low-region encoded data is applied to multiplexing section 106. In the present embodiment, because the use of G.718B is assumed, low-region signal encoding section 104 encodes the WB signal by the G.718 encoding system.

High-region signal encoding section 105 encodes the high-region part (high-region spectrum part) of the input signal based on the high-region encoding rate determined by bit rate determining section 102 to generate high-region encoded data. The high-region encoded data is applied to multiplexing section 106.

Multiplexing section 106 multiplexes the feature data, the low-region encoded data, and the high-region encoded data to generate multiplexed data. The multiplexed data is applied to RTP packet generating section 107.

RTP packet generating section 107 adds an RTP header to the front of the multiplexed data (RTP payload) to generate an RTP packet and transmits it to a non-illustrated decoding section.

Figure 3:
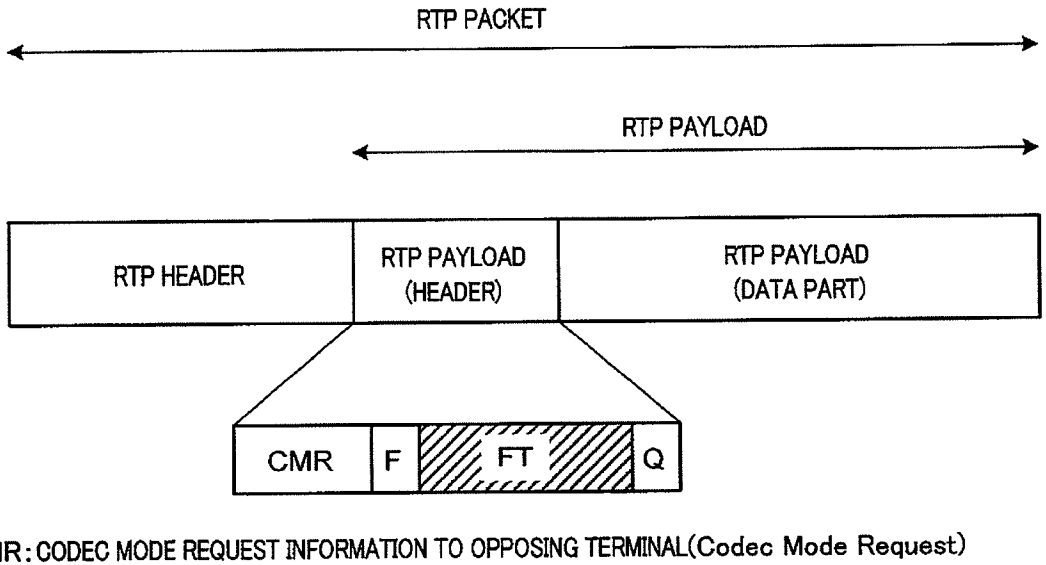
FIG. 3 is a drawing showing the structure of an RTP packet.

At this point, RTP-related terminology used in embodiments of the present invention will be described with reference to FIG. 3. An RTP packet, as shown in FIG. 3, is made up by an RTP header and an RTP payload. The RTP header is as noted in RFC (Request for Comments) 3550 (refer to NPL 4) of the IETF (Internet Engineering Task Force), and is a common header, regardless of the type of the RTP payload (codec type or the like). The format of the RTP payload differs, depending on the type of RTP payload. As shown in FIG. 3, although the RTP payload is made up of a header and a data part, there are types of RTP payloads for which the header does not exist. In this case, the description will be for an example in which the header exists. The header of the RTP payload includes information that identifies the number of data bits of encoded speech and/or a movie, or the like. The data part of the RTP payload includes the encoded data of a speech and/or a movie or the like.

In the case of using G.718B, there are five bit rate modes: the 28-kbit/s mode, the 32-kbit/s mode, the 36-kbit/s mode, the 40-kbit/s mode, and the 48-kbit/s mode (refer to FIG. 1). The FT field has stored into it information that identifies each of the modes.

In the present embodiment, the 28-kbit/s mode, the 32-kbit/s mode, the 36-kbit/s mode, the 40-kbit/s mode, and the 48-kbit/s mode are represented, respectively, by the bit rate information (three bits) of 0, 1, 2, 3, and 4, and the bit rate information corresponding to the selected bit rate mode is stored into the FT field.

FIG. 4 shows the relationship of correspondence between the bit rate mode, the bit rate information, and the size of the payload data part. For example, if the bit rate information stored in the FT field is 0, the bit rate mode is the 28-kbit/s mode, and if the frame length is 20 ms, the size of the data part of the payload is 560 bits. In the same manner, if the bit rate information is 1, 2, 3, and 4, the size of the data part of the payload would be, respectively, 640 bits, 720 bits, 800 bits, and 960 bits.

The details of feature analyzing section 101 and bit rate determining section 102 will be described below. In the following, the description uses the example of selecting the 40-kbit/s mode in accordance with an index of the network condition and the like, from the bit rate modes supported by G.718B.

If the 40-kbit/s mode is selected as the bit rate mode of G.718B, there are two combinations of the low-region encoding rate and high-region encoding rate, these being {24 kbit/s, 16 kbit/s} and {32 kbit/s, 8 kbit/s}.

If a plurality of combinations of the low-region encoding rate and the high-region encoding rate exist, bit rate determining section 102 analyzes the input signal feature and, in accordance with the analysis results, and selects one combination from among the plurality of candidate combinations.

A parameter that is associated with the amount of information included in common in the low-region part and the high-region part of the input signal is an appropriate input signal feature. That is, if the amount of information (the input signal feature value) included in common in the low-region part and the high-region part of the input signal is included in a relatively large amount in the low-region part, bit rate determining section 102 sets the low-region bit rate (low-region encoding rate) higher, and if the input signal feature value is included in a relatively large amount in the high-region part, bit rate determining section 102 sets the high-region bit rate (high-region encoding rate) higher.

Between {24 kbit/s, 16 kbit/s} and {32 kbit/s, 8 kbit/s}, {32 kbit/s, 8 kbit/s} has a low-region encoding rate that is higher than that of {24 kbit/s, 16 kbit/s}. Conversely, {24 kbit/s, 16 kbit/s} has a high-region encoding rate that is higher than that of {32 kbit/s, 8 kbit/s}.

Therefore, if the input signal feature value is included in a relatively large amount in the low region, bit rate determining section 102 selects {32 kbit/s, 8 kbit/s}, and if the input signal feature value is included in a relatively large amount in the high region, bit rate determining section 102 selects {24 kbit/s, 16 kbit/s}.

In this manner, bit rate determining section 102 selects the combination of bit rates appropriate to the input signal, in accordance with the input signal feature. Bit rate determining section 102 switches the bit rate in this manner in units of frames. By doing this, a bit rate suitable for the input signal feature is selected for each frame, thereby enabling achievement of encoding with high sound quality.

In the present embodiment, encoding apparatus 100 uses the signal energy as a parameter that is associated with the amount of information included in common in the low-region part and the high-region part.

That is, feature analyzing section 101 determines the energies of the low-region part (low-region signal) and the high-region part (high-region signal) of the input signal S(k).

Next, feature analyzing section 101 compares the difference in the logarithmic domain between the low-region signal energy and the high-region signal energy with a prescribed threshold value (refer to equation 1).

[1]

$$10\log_{10}\left(\sum_{k=0}^{FL} S(k)^2 / FL\right) - 10\log_{10}\left(\sum_{k=FL}^{FH} S(k)^2 / (FH - FL)\right) \geq TH \quad \text{(Equation 1)}$$

In the above, FL and FH represent, respectively, the maximum frequency in the low region and the maximum frequency in the high region of the input signal S(k), and TH is a prescribed threshold value. The first term of equation 1 represents the energy of the low-region signal SL(k), and the second term of equation 1 represents the energy of the high-region signal SH(k). Although the energies of the low-region signal SL(k) and the high-region signal SH(k) are represented as decibel values in equation 1, this is not a restriction, and the energies of both signals may be compared linearly.

Speech signals and music signals intrinsically tend to have more energy in the low region than in the high region. For this reason, it is appropriate to use 20 to 30 dB as the threshold value TH in equation 1.

Feature analyzing section 101 outputs the comparison result as feature data to bit rate determining section 102 and multiplexing section 106. For example, if equation 1 is true, and the input signal energy is included in a relatively large amount in the low region, feature analyzing section 101 outputs 0 as the feature data. If equation 1 is not true, and the input signal energy is included in a relatively large amount in the high region, feature analyzing section 101 outputs 1 as the feature data.

Based on the feature data, bit rate determining section 102 determines the bit rate (low-region encoding rate) of low-region signal encoding section 104 and the bit rate (high-region encoding rate) of high-region signal encoding section 105.

Specifically, if the feature data from feature analyzing section 101 is 0, because the input signal feature value is included in a relatively large amount in the low-region part, bit rate determining section 102 selects {32 kbit/s, 8 kbit/s}, which has a high low-region encoding rate, from {24 kbit/s, 16 kbit/s} and {32 kbit/s, 8 kbit/s}. Bit rate determining section 102 then sets the low-region encoding rate to 32 kbit/s and sets the high-region encoding rate to 8 kbit/s.

If, however, the feature data from feature analyzing section 101 is 1, because the input signal feature value is included in a relatively large amount in the high-region part, bit rate determining section 102 selects {24 kbit/s, 16 kbit/s}, which has a high high-region encoding rate, from {24 kbit/s, 16 kbit/s} and {32 kbit/s, 8 kbit/s}. Bit rate determining section 102 then sets the low-region encoding rate to 24 kbit/s and sets the high-region encoding rate to 16 kbit/s.

When the low-region encoding rate and the high-region encoding rate are set in this manner, bit rate determining section 102 outputs information of the set low-region encoding rate to low-region signal encoding section 104 and outputs information of the set high-region encoding rate to high-region signal encoding section 105.

Next, the decoding apparatus according to the present embodiment will be described with reference to FIG. 5.

Figure 5:
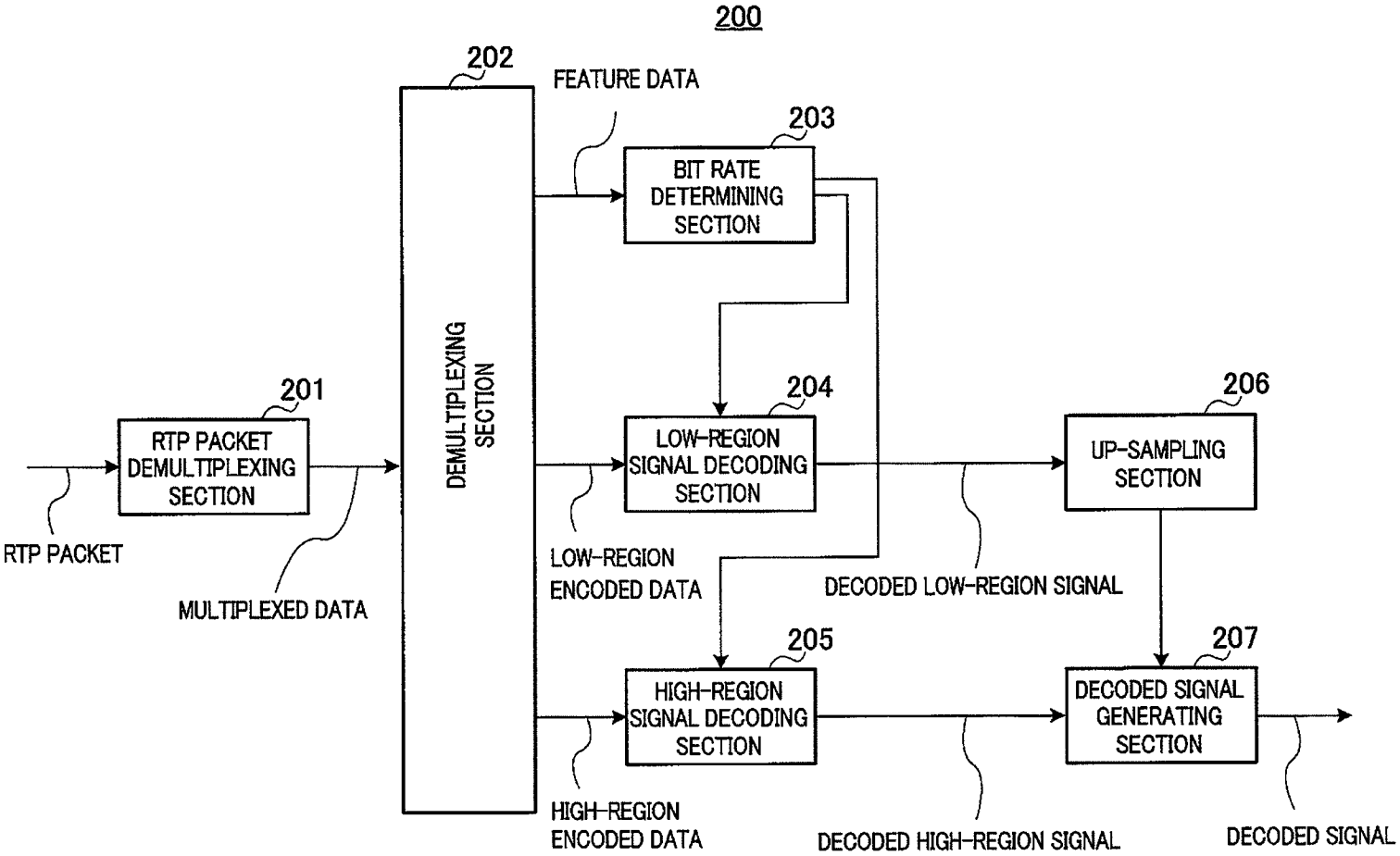
FIG. 5 is a block diagram showing the constitution of a decoding apparatus according to Embodiment 1 of the present invention.

FIG. 5 is a block diagram showing the constitution of a decoding apparatus according to the present embodiment. Decoding apparatus 200 in FIG. 5 has RTP packet demultiplexing section 201, demultiplexing section 202, bit rate determining section 203, low-region signal decoding section 204, high-region signal decoding section 205, up-sampling section 206, and decoded signal generating section 207.

RTP packet demultiplexing section 201 references the FT field of the header of the RTP payload included in the RTP packet sent from encoding apparatus 100 and, based on the bit rate information described in the FT field, identifies the size of the data part (multiplexed data) of the RTP payload. As shown in FIG. 4, in the present embodiment, if the bit rate information indicates 0, 1, 2, 3, and 4, the payload size is, respectively, 560 bits, 640 bits, 720 bits, 800 bits, and 960 bits. In this manner, RTP packet demultiplexing section 201 identifies the payload size in accordance with the bit rate information described in the FT field and, in accordance with the payload size, extracts the data part of the RTP payload from the RTP packet, and outputs the data part as multiplexed data to demultiplexing section 202.

Demultiplexing section 202 demultiplexes the multiplexed data into the feature data, the low-region encoded data, and the high-region encoded data, and outputs the data, respectively, to bit rate determining section 203, low-region signal decoding section 204, and high-region signal decoding section 205.

Based on the feature data, bit rate determining section 203, similar to bit rate determining section 102, determines the bit rate of low-region signal decoding section 204 (that is, the low-region encoding rate), and the bit rate of high-region signal decoding section 205 (that is, the high-region encoding rate). Bit rate determining section 203 also notifies low-region signal decoding section 204 of the low-region encoding rate information and notifies high-region signal decoding section 205 of the high-region encoding rate information.

Low-region signal decoding section 204 decodes the low-region encoded data based on the low-region encoding rate determined by bit rate determining section 203 to generate a decoded low-region signal. Low-region signal decoding section 204 outputs the decoded low-region signal to up-sampling section 206.

High-region signal decoding section 205 decodes the high-region encoded data based on the high-region encoding rate determined by bit rate determining section 203 to generate a decoded high-region signal. High-region signal decoding section 205 outputs the decoded high-region signal to decoded signal generating section 207.

Up-sampling section 206 up-samples the decoded low-region signal to generate a signal having a sampling rate of, for example 32 kHz. Up-sampling section 206 outputs the up-sampled decoded low-region signal to decoded signal generating section 207.

Decoded signal generating section 207 performs adding processing or the like with respect to the decoded low-region signal and the decoded high-region signal after up-sampling to generate a decoded signal having a sampling rate of, for example, 32 kHz, and outputs the decoded signal.

As noted above, in encoding apparatus 100, feature analyzing section 101 extracts a input signal feature value. Then, bit rate determining section 102, based on the input signal feature value, determines a combination of the encoding rate (low-region encoding rate) of low-region signal encoding section 104 that encodes the low-region part of the input signal and the encoding rate (high-region encoding rate) of high-region signal encoding section 105 that encodes the high-region part of the input signal.

That is, feature analyzing section 101 acquires the input signal feature value for each of the low-region part and the high region part, analyzes whether the feature value is included more in the low-region part or the high-region part, and outputs the analysis results (feature data). Then, based on the total encoding rate, which is the total of the low-region encoding rate and the high-region encoding rate and which is pre-set by an index such as the network condition, and on the analysis results, bit rate determining section 102 determines, from among the pre-set candidate combinations of the low-region encoding rate and the high-region encoding rate, the combination of the low-region encoding rate and the high-region encoding rate actually to be used by low-region signal encoding section 104 and high-region signal encoding section 105.

The energy of the low-region part and the high-region part of the input signal is extracted as the input signal feature value by feature analyzing section 101. Feature analyzing section 101 then analyzes which of low-region part and the high-region part includes more energy.

In decoding apparatus 200, demultiplexing section 202 demultiplexes the multiplexed data in which the low-region encoded data, the high-region encoded data, and the analysis results (feature data) indicating whether the input signal feature value obtained for each of the low-region part and the high-region part is included more in the high-region part or the low-region part are multiplexed, into the low-region encoded data, the high-region encoded data, and the analysis results (feature data). Then, based on the total encoding rate, which is the total of the low-region encoding rate and the high-region encoding rate and which is pre-set by an index such as the network condition, and on the analysis results (feature data), bit rate determining section 203 determines, from among the pre-set candidate combinations of the low-region encoding rate and the high-region encoding rate the combination of the low-region encoding rate and the high-region encoding rate actually to be used by low-region signal decoding section 204 and high-region signal decoding section 205.

By doing this, it is possible to switch the combination of the low-region encoding rate and the high-region encoding rate of the input signal adaptively in response to the input signal feature, enabling achievement of high sound quality.

The above description is for the case in which feature analyzing section 101 uses the energy of the low-region part of the input signal (low-region signal SL(k)) and the energy of the high-region part of the input signal (high-region signal SH(k)) as the input signal feature value. In this case, with respect to a signal, such as a music signal, having a large high-region energy, the high-region encoding rate can be set high, thereby enabling achievement of high sound quality with a small amount of calculation.

The input signal feature value is not restricted to the above, and may be information that is included in common in the low-region signal and the high-region signal. For example, feature analyzing section 101 may be made to determine the LPC (linear predictive coding) predicted gain as the input signal feature value.

This is based on the following concept. Specifically, in the case of using CELP (code-excited linear prediction) in low-region signal encoding section 104, the CELP performance is generally determined by whether or not the input signal is a signal suitable for the LPC prediction model. That is, in the case of an input signal that is unsuitable for the LPC prediction model (for example, a music signal), even if the bit rate (low-region encoding rate) of low-region signal encoding section 104 is made high, the improvement in the performance of low-region signal encoding section 104 is limited. Rather than do that, making the bit rate (high-region encoding rate) of high-region signal encoding section 105 high will improve the overall performance and lead to an improvement in sound quality. Conversely, in the case of an input signal that is suitable for the LPC prediction model (for example, a speech signal), the overall sound quality is improved more by suppressing the bit rate (high-region encoding rate) of high-region signal encoding section 105 and by making the bit rate (low-region encoding rate) of low-region signal encoding section 104 high, so as to improve the performance of low-region signal encoding section 104.

Based on the above-noted concept, feature analyzing section 101 may be made to determine the LPC predictive gain of the input signal as the input signal feature value and to set the feature data based on the LPC predicted gain.

Feature analyzing section 101 calculates the LPC predicted gain as follows. Feature analyzing section 101 first uses the LPC coefficient $\alpha(i)$ to perform linear prediction with respect to the input signal s(n), and then calculates the LPC residue signal e(n).

[2]

$$e(n) = s(n) - \sum_{i=1}^{NP} \alpha(i) \cdot s(n-i) \quad \text{(Equation 2)}$$

In the above, NP is the order of the LPC coefficients.

Next, feature analyzing section 101 calculates the energy ratio between the input signal and the LPC residue signal in the logarithm domain, and takes this as the LPC gain. The LPC gain is calculated by the following equation.

[3]

$$G_{LPC} = 10\log_{10}\left(\sum_{n=0}^{NF} s(n)^2 \Big/ \sum_{n=0}^{NF} e(n)^2\right) \quad \text{(Equation 3)}$$

In the above, $G_{LPC}$ is the LPC gain, and NF is the frame length.

Feature analyzing section 101 then compares the LPC gain to a prescribed threshold value, and outputs the comparison result as feature data to bit rate determining section 102 and multiplexing section 106. For example, if the LPC gain is at least the prescribed threshold value and the input signal is a signal suitable for the LPC prediction model, feature analyzing section 101 outputs 0 as the feature data. If the LPC gain is below the prescribed threshold value and the input signal is not a signal suitable for the LPC prediction model, feature analyzing section 101 outputs 1 as the feature data.

By doing this, if the feature data from feature analyzing section 101 is 0, because the input signal is suitable for the LPC prediction model, of the plurality of combinations of encoding rates {24 kbit/s, 16 kbit/s} and {32 kbit/s, 8 kbit/s}, bit rate determining section 102 selects the combination {32 kbit/s, 8 kbit/s}, in which the low-region encoding rate is high. That is, bit rate determining section 102 sets the low-region encoding rate to 32 kbit/s and sets the high-region encoding rate to 8 kbit/s.

If, however, the feature data from feature analyzing section 101 is 1, because the input signal is unsuitable for the LPC prediction model, of the plurality of combinations of encoding rates {24 kbit/s, 16 kbit/s} and {32 kbit/s, 8 kbit/s}, bit rate determining section 102 selects the combination {24 kbit/s, 16 kbit/s}, in which the high-region encoding rate is high. That is, bit rate determining section 102 sets the low-region encoding rate to 24 kbit/s and sets the high-region encoding rate to 16 kbit/s.

By using the LPC gain as the input signal feature value in this manner, the performance of low-region signal encoding section 104 can be predicted. Also, because only a small amount of calculation is required for calculating the LPC gain, it is possible to achieve a low amount of calculation.

Feature analyzing section 101 may calculate the LPC coefficients with respect to the input signal or with respect to a low-region signal. In the latter case, the low-region signal $s_{low}(n)$ is used in place of the input signal s(n) in equation 2, in calculating the LPC gain. The LPC coefficients with respect to the low-region signal $s_{low}(n)$ may be the LPC coefficients before quantization determined in the encoding processing by low-region signal encoding section 104 or the LPC coefficients after quantization. In this case, it is possible to determine the combination of the low-region encoding rate and the high-region encoding rate before encoding the low-region part of the input signal, thereby enabling a reduction in the amount of calculation.

Because the constitution of the decoding apparatus in the case of decoding the multiplexed data that includes the feature data set based on the LPC gain is the same as the constitution of decoding apparatus 200, its drawing and description are omitted herein.

Embodiment 2

Figure 6:
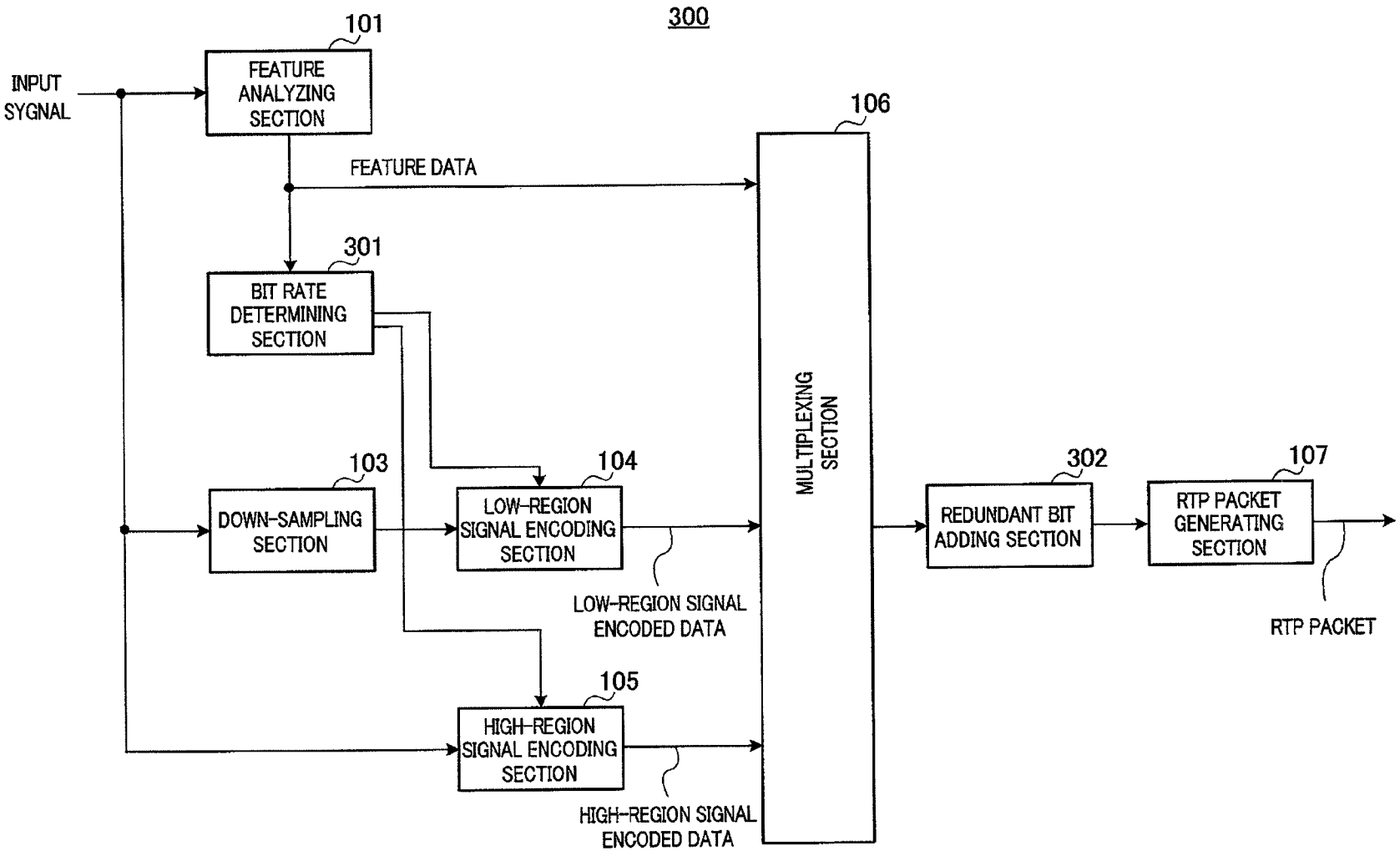
FIG. 6 is a block diagram showing the constitution of an encoding apparatus according to Embodiment 2 of the present invention.

FIG. 6 is a block diagram showing the constitution of an encoding apparatus according to the present embodiment. In FIG. 6 constituent elements that are in common with those in FIG. 2 are assigned the same reference signs, and the descriptions thereof are omitted herein. Encoding apparatus 300 in FIG. 6, in contrast to encoding apparatus 100 in FIG. 2, has bit rate determining section 301 in place of bit rate determining section 102, and adopts a constitution in which redundant bit adding section 302 is additionally inserted between multiplexing section 106 and RTP packet generating section 107.

The present embodiment is described for the case in which, of the bit rate modes supported by G.718B, the 36-kbit/s mode is selected in accordance with an index of the network condition or the like.

If the 36-kbit/s mode is selected as the G.718B bit rate mode, the combination of the low-region encoding rate and the high-region encoding rate is only {32 kbit/s, 4 kbit/s}. For this reason, in Embodiment 1, bit rate determining section 102 sets the low-region encoding rate to 32 kbit/s and the high-region encoding rate to 4 kbit/s. Bit rate determining section 102 outputs, to low-region signal encoding section 104 and high-region signal encoding section 105, information indicating that the low-region encoding rate and the high-region encoding rate are, respectively 32 kbit/s and 4 kbit/s.

However, if the feature data from feature analyzing section 101 is 1, that is, if it is judged that there is a relatively large amount of information included in the high-region part of the input signal, a high-region encoding rate of 4 kbit/s is insufficient, and using 8 kbit/s, which is higher than 4 kbit/s, as the high-region encoding rate enables better sound quality.

Given this, in the present embodiment bit rate determining section 301 selects the 32-kbit/s mode, which has an overall bit rate (total encoding rate) that is lower than the pre-set 36-kbit/s mode and also has a higher high-region encoding rate than the 36-kbit/s mode.

That is, if the feature data from feature analyzing section 101 is 1, bit rate determining section 301 sets the bit rate (low-region encoding rate) of low-region signal encoding section 104 to 24 kbit/s, and sets the bit rate of high-region signal encoding section 105 (high-region encoding rate) to 8 kbit/s. Bit rate determining section 301 then outputs, to low-region signal encoding section 104 and high-region signal encoding section 105, information indicating that the low-region encoding rate and the high-region encoding rate are, respectively, 24 kbit/s and 8 kbit/s.

In this manner, in the present embodiment, if the feature data from feature analyzing section 101 indicates 1, that is, if the judgment is made that a relatively large amount of information is included in the high-region part of the input signal, the bit rate mode is set to the 32-kbit/s mode, in which the high-region encoding rate is 8 kbit/s, which is higher than 4 kbit/s.

If the bit rate mode is 36 kbit/s, the payload size is 720 bits (refer to FIG. 4). In contrast, when the bit rate mode is 32 kbit/s, the payload size is 640 bits (refer to FIG. 4). That is, by changing the bit rate mode from 36 kbit/s to 32 kbit/s, the payload size is shortened by 80 bits (720−640), which corresponds to the difference of 4 kbit/s between the bit rates. However, in accordance with an index of the network conditions or the like, because 36 kbit/s is already selected as the overall bit rate (total encoding rate), it is necessary to augment a deficiency of 80 bits.

Given this, in the present embodiment a redundant bit adding section 302 is provided between multiplexing section 106 and RTP packet generating section 107, redundant bit adding section 302 adding the missing bits that occur because of the change in the bit rate.

Specifically, redundant bit adding section 302 references the multiplexed data sent from multiplexing section 106 to see if the feature data is 0 or 1. Then, if the feature data is 1, redundant bit adding section 302 adds the missing 80 redundant bits (that is, 4 kbit/s) to the multiplexed data, making the overall bit rate be 36 kbit/s. The multiplexed data to which the redundant bits have been added is then output to RTP package generating section 107.

By doing this, the following effects are achieved. The first effect is that, if there are a plurality combinations of the low-region encoding rate and the high-region encoding rate to implement the set overall bit rate (total encoding rate), bit rate determining section 301, similar to the case of bit rate determining section 102 in Embodiment 1, adaptively switches the low-region encoding rate and the high-region encoding rate in accordance with the input signal feature. By doing this, it is possible to achieve high sound quality.

The second effect is that, by adding redundant bits to the multiplexed data by redundant bit adding section 302, it is possible to restrict the number of different overall bit rates (total encoding rates). By doing this, it is possible to reduce the number of bits required in the FT field of the RTP payload header, thereby reducing the number of bits required in the RTP payload header and enabling efficient use of the network.

In Embodiment 1, as shown in FIG. 1, the selectable bit rate modes are the five modes of the 28-kbit/s mode, the 32-kbit/s mode, the 36-kbit/s mode, the 40-kbit/s mode, and the 48-kbit/s mode. For this reason, three bits are required in the FT field of the RTP payload header. In contrast to this, in the present embodiment, the 32-kbit/s mode is removed from the selectable modes. For this reason, because the selectable bit rate modes are limited to the four modes of the 28-kbit/s mode, the 36-kbit/s mode, the 40-kbit/s mode, and the 48-kbit/s mode, it is possible to reduce the number of bits required in the FT field to two bits.

In this manner, in the present embodiment, in addition to adaptively switching the low-region encoding rate and the high-region encoding rate in accordance with the input signal feature to achieve high sound quality, it is possible to improve the efficiency of utilization of the network by restricting the number of bits required in the FT field.

Figure 7:
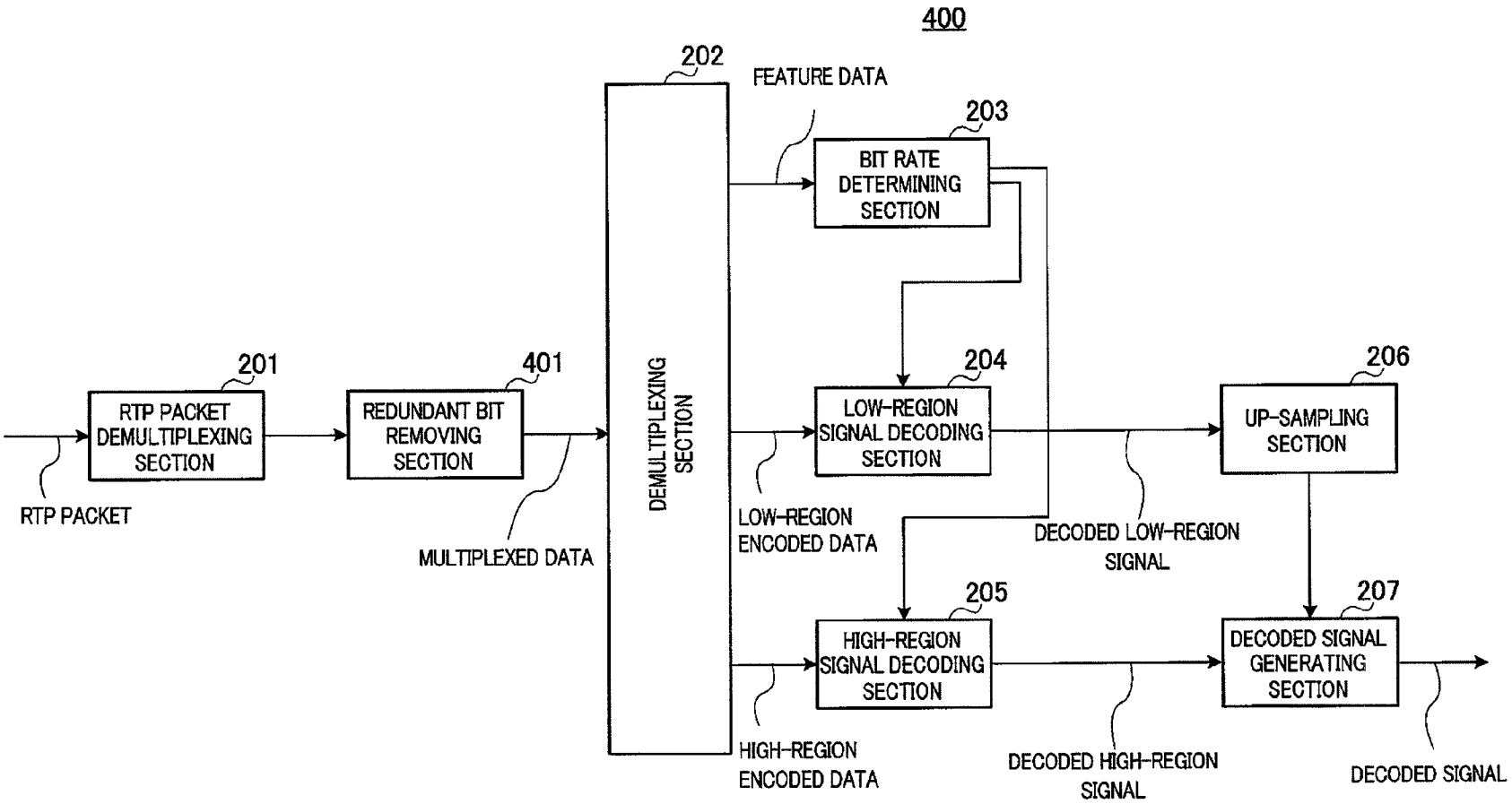
FIG. 7 is a block diagram showing the constitution of a decoding apparatus according to Embodiment 2 of the present invention.

FIG. 7 is a block diagram showing the constitution of a decoding apparatus according to the present embodiment. In FIG. 7, constituent elements that are the same as in FIG. 5 are assigned the same reference signs, and the descriptions thereof are omitted herein. Decoding apparatus 400 in FIG. 7, in contrast to decoding apparatus 200 in FIG. 5, adopts a constitution in which redundant bit removing section 401 is inserted between RTP packet demultiplexing section 201 and demultiplexing section 202. The following description is of the case in which, of the bit rate modes supported by G.718B, the 36-kbit/s mode is selected in accordance with an index of the network condition or the like.

Redundant bit removing section 401 references the multiplexed data to see if the feature data is 0 or 1. If the feature data is 1, redundant bit removing section 401 judges that 80 redundant bits (that is 4 kbit/s) have been added to the multiplexed data. Given this, if the feature data is 1, redundant bit removing section 401 removes the redundant bits from the multiplexed data and outputs the multiplexed data after removal of the redundant bits to demultiplexing section 202. If, however, the feature data is 0, because there are no redundant bits in the multiplexed data, redundant bit removing section 401 outputs the multiplexed data without modification to demultiplexing section 202.

Because subsequent operation is the same as in Embodiment 1, the description thereof is omitted herein.

As described above, in the present embodiment, based on the results of analysis by feature analyzing section 101 (feature data), bit rate determining section 301 restricts the combination candidates of encoding rates and determines, from among the combination candidates after being restricted, the combination of encoding rates to be actually used by low-region signal encoding section 104 and high-region signal encoding section 105. Redundant bit adding section 302 then adds, to the multiplexed data, redundant bits in accordance with the difference between the total encoding rate of the determined combination and the pre-set total encoding rate. Redundant bit removing section 401 then removes redundant bits that have been added to the multiplexed data, and that are redundant bits in accordance with the difference between the total encoding rate of the determined combination and the pre-set total encoding rate. By doing this, it is possible to restrict the number of different overall bit rates (total encoding rates), and possible to reduce the number of bits required in the FT field of the RTP payload header. As a result, it is possible to reduce the number of bits required in the RTP payload header and to achieve efficient network usage.

Embodiment 3

Embodiment 3 will be described below, with references made to drawings. A feature of this embodiment is the use of information included in the encoded data transmitted from the encoding apparatus to the decoding apparatus in determining the low-region encoding rate and the high-region encoding rate. That is, the bit rate is determined based on information that can be used by both the encoding apparatus and the decoding apparatus. By virtue of this feature, because it is not necessary to encode information of the feature data required in order to determine the bit rate, it is possible to reduce the amount of information.

A constitution for determining the combination of bit rates using the frame mode, which indicates the signal feature included in the frame will be described, with the assumption of using G.718 for encoding a low-region signal.

In G.178, the low-region signal is analyzed frame-by-frame, and classified into the four frame modes of Unvoiced (UC), Voiced (VC), Transition (TC), and Generic (GC). Quantizing of the LPC coefficients and encoding of the excitation information is performed as appropriate to each of the frame modes, so as to improve the sound quality. When this is done, the frame mode is included in the encoded data that is transmitted to the decoding section.

Figure 8:
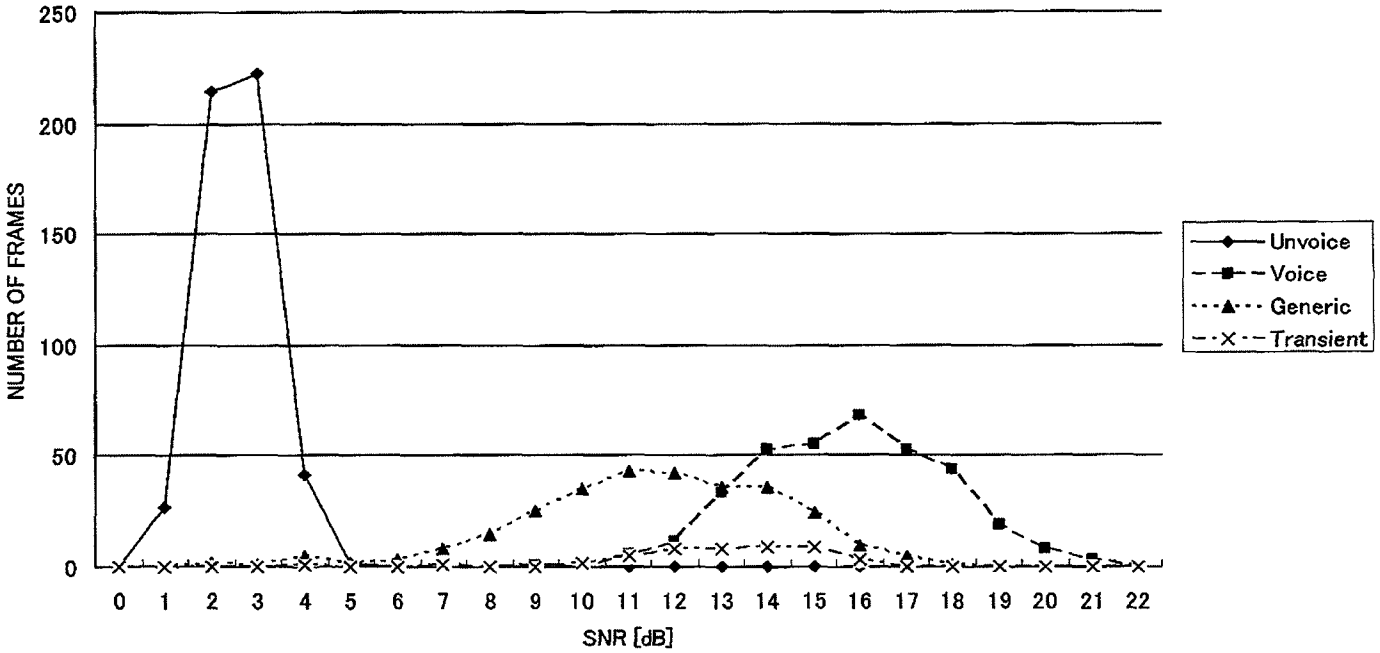
FIG. 8 is a graph showing the results of an investigation of the SNR for each frame mode.
Figure 9:
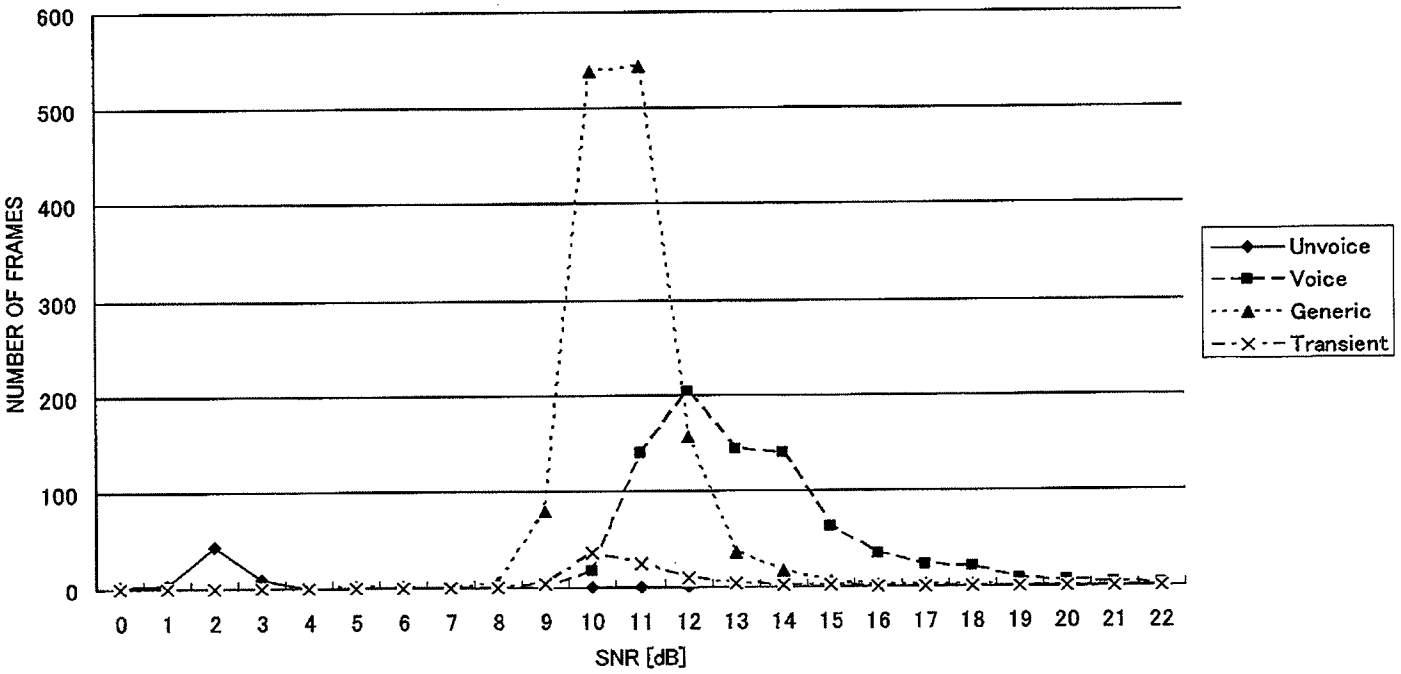
FIG. 9 is a graph showing the results of an investigation of the SNR for each frame mode.

When a low-region signal is encoded using G.718, the results of testing the SNR for each frame mode are as shown in FIG. 8 and FIG. 9. FIG. 8 is for the case of using an approximately 24-second speech signal, and FIG. 9 is for the case of using an approximately 45-second music signal. In FIG. 8 and FIG. 9, the horizontal axis represents SNR and the vertical axis represents the number of frames when that SNR is reached.

The SNR can be viewed as an index that indicates the encoding performance. When the SNR is high, distortion caused by encoding is made low, and the audible sound quality is high. Conversely, when the SNR is low, a large amount of distortion caused by encoding remains and the audible sound quality is low.

As is clear from FIG. 8 and FIG. 9, it can be seen that there is a strong correlation between the frame mode and the SNR. That is, frames classified as UC often have a low SNR, and the other frames classified as VC, TC, and GC often have a high SNR.

Therefore, in the case of a frame classified as UC, because the low-region signal SNR is low, the low-region encoding rate is set high, and the high-region encoding rate is set commensurately lower. Conversely, for frames classified as VC, TC, and GC, because the low-region signal SNR is high, the low-region encoding rate is set to lower, and the high-region encoding rate is set commensurately higher.

Although the foregoing is the description for an example of the method of determining the low-region encoding rate and the high-region encoding rate for the case of UC and the cases of VC, TC, and GC, the present invention is not restricted to this manner, and the constitution may be such that different combinations of bit rates are selected for each frame mode.

By using the frame mode in this manner to determine the low-region encoding rate and the high-region encoding rate, it is possible to specify appropriately low-region and thigh-region encoding rates without adding information and perform encoding and decoding. By doing this, it is possible to improve the sound quality without encoding information that indicates the bit rate combination.

Figure 10:
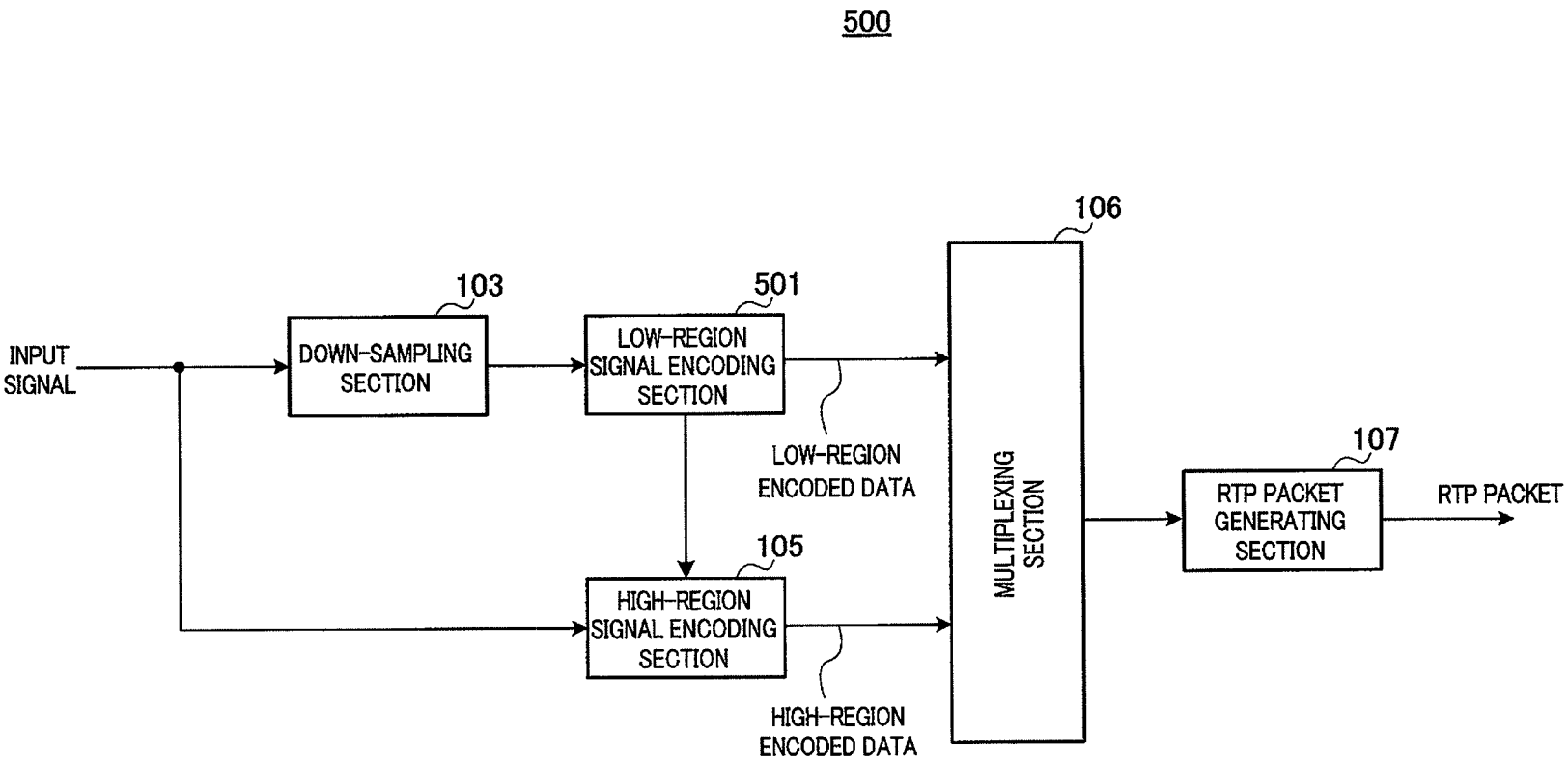
FIG. 10 is a block diagram showing the constitution of an encoding apparatus according to Embodiment 3 of the present invention.

Next, the constitution of the encoding apparatus of the present embodiment will be described with reference to FIG. 10 and FIG. 11. In FIG. 10, blocks that have the same names as those in FIG. 2 will not be described. Encoding apparatus 500 in FIG. 10, in contrast to encoding apparatus 100 in FIG. 2, does not have feature analyzing section 101 and bit rate determining section 102. Additionally, the function of low-region signal encoding section 501 of encoding apparatus 500 differs from the function of low-region encoding section 104 of encoding apparatus 100.

Low-region signal encoding section 501 determines the low-region encoding rate and the high-region encoding rate using the encoding information used in encoding the low-region part of the input signal, and outputs the high-region encoding rate information to high-region signal encoding section 105. Low-region signal encoding section 501, based on the low-region encoding rate, encodes the low-region part of the input signal, generates the low-region encoded data, and output the low-region encoded data to multiplexing section 106.

Figure 11:
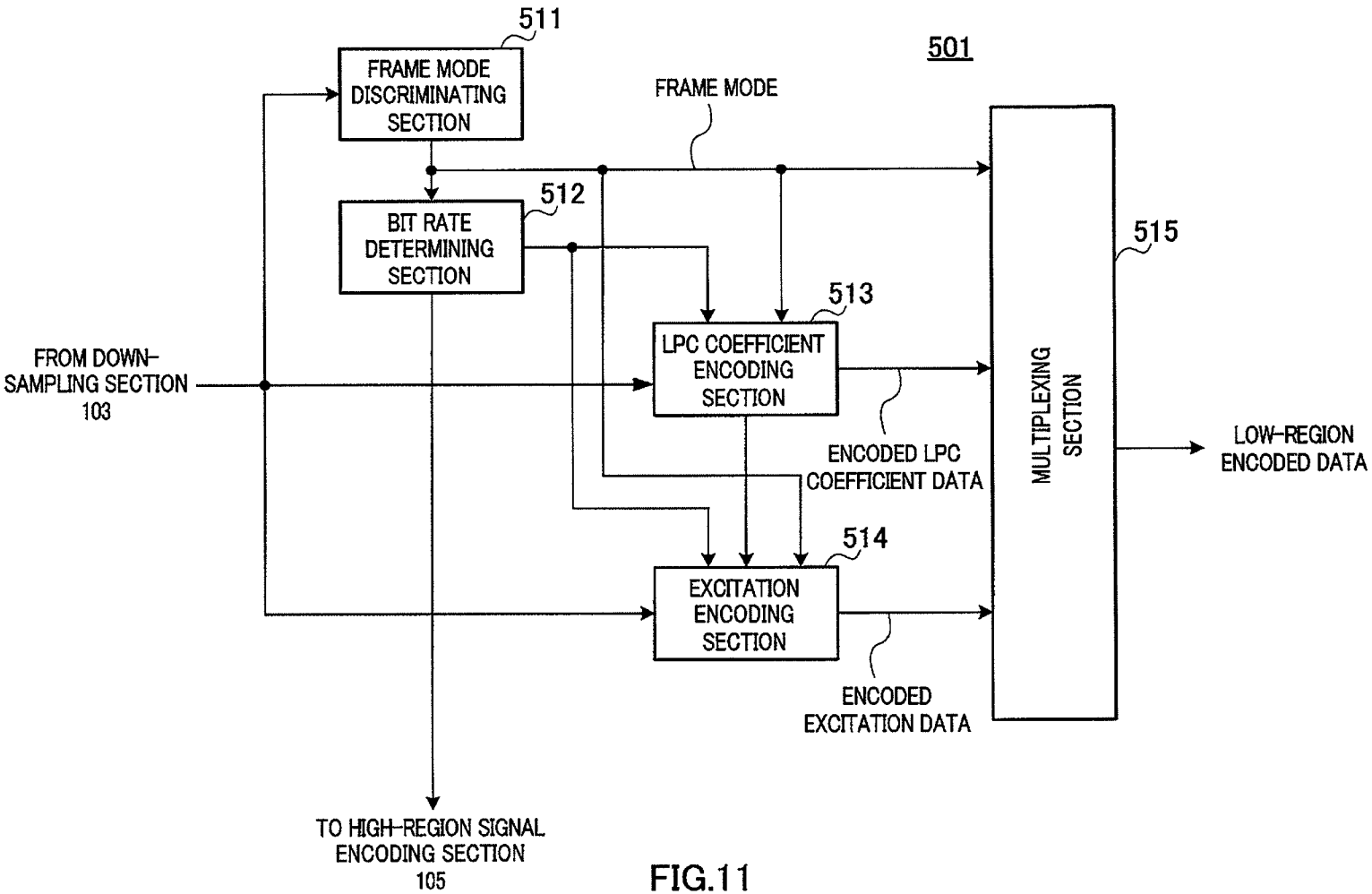
FIG. 11 is a block diagram showing the internal constitution of a low-region signal encoding section according to Embodiment 3 of the present invention.

FIG. 11 is a block diagram showing the internal constitution of low-region signal encoding section 501. At this point, the portion of the constitution that determines the low-region encoding rate and the high-region encoding rate using the frame mode as the encoding information will be described.

Low-region signal encoding section 501 is constituted to mainly include frame mode discriminating section 511, bit rate determining section 512, LPC coefficient encoding section 513, excitation encoding section 514, and multiplexing section 515. In low-region signal encoding section 501, the output signal of down-sampling section 103 is input to frame mode discriminating section 511, LPC coefficient encoding section 513, and excitation encoding section 514.

Frame mode discriminating section 511 analyzes the output signal of the down-sampling section 103 and discriminates whether each frame belongs to Unvoiced (UC), Voiced (VC), Transition (TC), or Generic (GC). As the method of analysis, signal energy, spectrum slope, short-term predictive gain, long-term predictive gain, or the like are used. Frame mode discriminating section 511 outputs the frame mode indicating the discrimination result to bit rate determining section 512, LPC coefficient encoding section 513, excitation encoding section 514, and multiplexing section 515.

Bit rate determining section 512, based on the frame mode, determines the low-region encoding rate and the high-region encoding rate. From the relationship between the frame mode and the SNR shown in FIG. 8 and FIG. 9, for frame for which UC is selected, bit rate determining section 512 sets the low-region encoding rate high and sets the high-region encoding rate commensurately lower. If G.718 is used in low-region signal encoding section 501, and the bit rate mode is 40 kbit/s, the combination of the low-region encoding rate and the high-region encoding rate is {32 kbit/s, 8 kbit/s}. For frames for which VC, TC, or GC is selected, the low-region encoding rate is set low, and the high-region encoding rate is set commensurately higher. If G.718 is used in low-region signal encoding section 501, and the bit rate mode is 40 kbit/s, the combination of the low-region encoding rate and the high-region encoding rate is {24 kbit/s, 16 kbit/s}. Bit rate determining section 512 outputs information of the determined low-region encoding rate to LPC coefficient encoding section 513 and excitation encoding section 514, and output information of the high-region encoding rate to high-region signal encoding section 105.

LPC coefficient encoding section 513, based on a pre-established plurality of bit rates, encodes LPC coefficients. LPC coefficient encoding section 513 performs LPC analysis of the input signal after down-sampling that is output from down-sampling section 103, so as to determine the LPC coefficients. The LPC coefficients are converted to parameters (for example, linear spectral pairs (LSPs)) that are suitable for quantization. LPC coefficient encoding section 513, based on the frame mode and low-region encoding rate information, quantizes the parameters, so as to generate encoded LPC coefficient data. LPC coefficient encoding section 513 outputs the encoded LPC coefficient data to multiplexing section 515. LPC coefficient encoding section 513 also decodes the encoded LPC coefficient data to determine the decoded LPC coefficients, and outputs them to excitation encoding section 514.

Excitation encoding section 514, based on a plurality of pre-established bit rates, encodes the excitation information. Excitation encoding section 514 encodes the excitation information of the down-sampled input signal, based on information regarding the decoded LPC coefficients, the frame mode, and the low-region encoding rate, so as to generate encoded excitation data. Excitation encoding section 514 outputs the encoded excitation data to multiplexing section 515.

Multiplexing section 515 multiplexes the frame mode, the encoded LPC coefficient data, and the encoded excitation data so as to generate low-region encoded data. Multiplexing section 515 outputs the low-region encoded data to multiplexing section 106. Multiplexing section 515 shown in FIG. 11 is not necessarily an essential constituent element, and the frame mode discrimination information, encoded LPC coefficients data, and encoded excitation data may be output directly to multiplexing section 106 as the low-region encoding data, in which case multiplexing section 515 of FIG. 11 become unnecessary.

Figure 12:
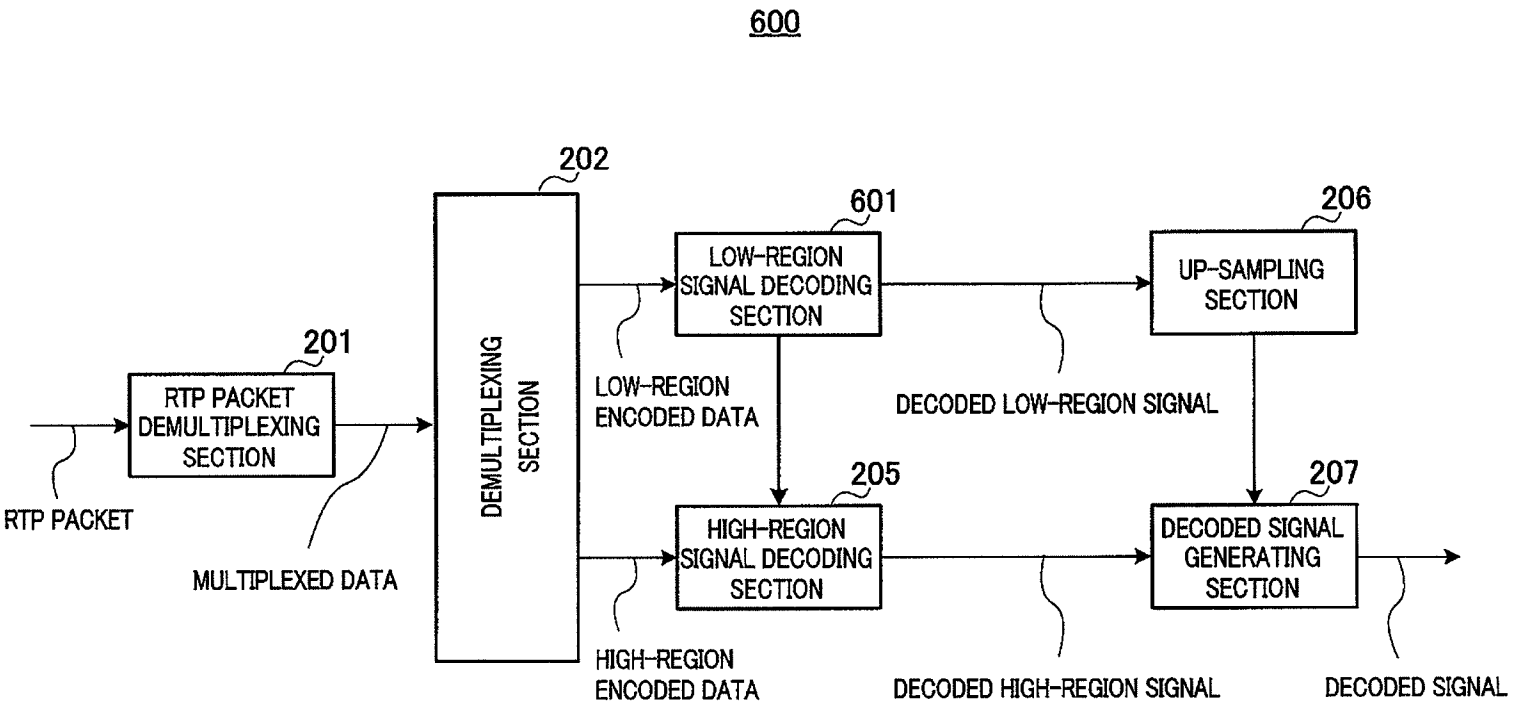
FIG. 12 is a block diagram showing the constitution of a decoding apparatus according to Embodiment 3 of the present invention.

Next, the constitution of the decoding apparatus according to the present embodiment will be described with reference to FIG. 12 and FIG. 13. In decoding apparatus 600 as shown in FIG. 12, the descriptions of blocks having the same names as those in decoding apparatus 200 shown in FIG. 5 will be omitted. Decoding apparatus 600 of FIG. 12, in contrast to decoding apparatus 200 of FIG. 5, does not have bit rate determining section 203. Additionally, the function of low-region signal encoding section 601 of decoding apparatus 600 differs from that of low-region signal decoding section 204 of encoding apparatus 200.

Low-region signal decoding section 601, using information included in the low-region encoded data output from demultiplexing section 202, determines the bit rate (that is, the low-region encoding rate) of low-region signal decoding section 601 and the bit rate (that is, the high-region encoding rate) of high-region signal decoding section 205 so as to output information of the high-region encoding rate to high-region signal decoding section 205. Low-region signal decoding section 601, based on the low-region encoding rate, decodes the encoded low-region data so as to generate a decoded low-region signal. Low-region signal decoding section 601 outputs the decoded low-region signal to up-sampling section 206.

Figure 13:
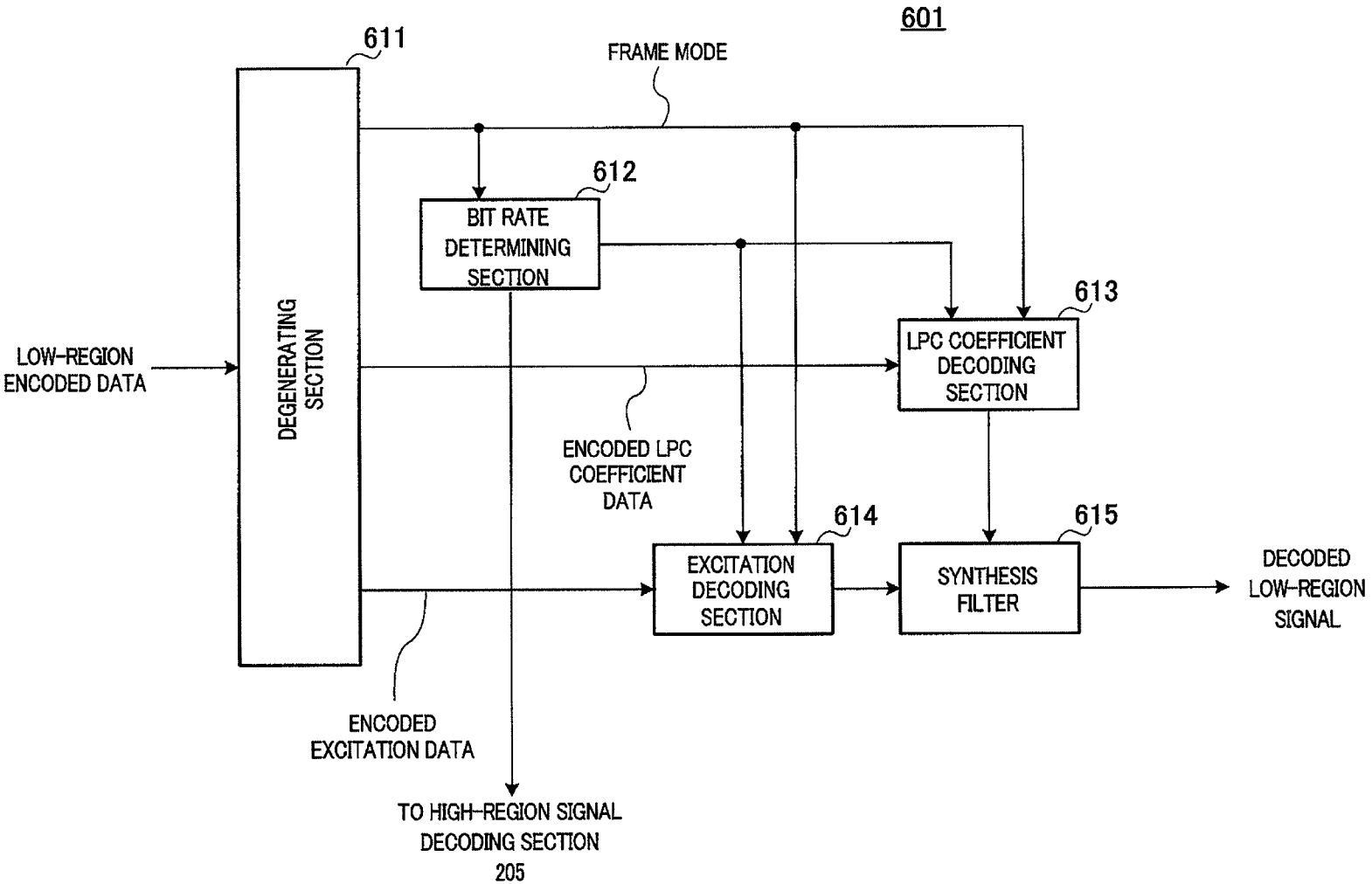
FIG. 13 is a block diagram showing the internal constitution of a low-region signal decoding section according to Embodiment 3 of the present invention.

FIG. 13 is a block diagram showing the internal constitution of low-region signal decoding section 601. Low-region signal decoding section 601 is constituted mainly by demultiplexing section 611, bit rate determining section 612, LPC coefficient decoding section 613, excitation decoding section 614, and synthesis filter 615.

Demultiplexing section 611 demultiplexer the encoded low-region data into the frame mode, the encoded LPC coefficient data, and encoded excitation data.

Bit rate determining section 612, based on the frame mode, determines the low-region encoding rate and the high-region encoding rate. From the relationship between the frame mode and the SNR shown in FIG. 8 and FIG. 9, for frame for which UC is selected, the low-region encoding rate is set high and the high-region encoding rate is set commensurately lower. If G.718 is used in low-region signal decoding section 601, and the bit rate mode is 40 kbit/s, the combination of the low-region encoding rate and the high-region encoding rate is {32 kbit/s, 8 kbit/s}. For frames for which VC, TC, or GC is selected, the low-region encoding rate is set low, and the high-region encoding rate is set commensurately higher. If G.718 is used in low-region signal decoding section 601, and the bit rate mode is 40 kbit/s, the combination of the low-region encoding rate and the high-region encoding rate is {24 kbit/s, 16 kbit/s}. Bit rate determining section 612 outputs information of the determined low-region encoding rate to LPC coefficient decoding section 613 and excitation encoding section 614, and outputs information of the high-region encoding rate to high-region signal decoding section 205.

LPC coefficient decoding section 613, based on a pre-established plurality of bit rates, decodes the LPC coefficients. LPC coefficient decoding section 613, based on the encoded LPC coefficient data, and on information regarding the frame mode and the low-region encoding rate, decodes the LPC coefficients so as to generate decoded LPC coefficients, and outputs them to synthesis filter 615.

Excitation decoding section 614, based on a pre-established plurality of bit rates, decodes the excitation signal. Excitation decoding section 614, using information regarding the frame mode and the low-region encoding rate, decodes encoded excitation data so as to generate an excitation signal, and outputs it to synthesis filter 615.

Synthesis filter 615 constitutes a synthesis filter based on the decoded LPC coefficients. The excitation signal is passed through the synthesis filter 615, thereby filtering it to generate a decoded low-region signal. Synthesis filter 615 outputs the decoded low-region signal to up-sampling section 206. Demultiplexing section 611 is not necessarily an essential constituent element, and the frame mode, the encoded LPC coefficient data, and the encoded excitation data may be output from demultiplexing section 202 shown in FIG. 12 directly to bit rate determining section 612, LPC coefficient decoding section 613, and excitation decoding section 614. In this case, demultiplexing section 611 is not necessary.

The present invention may adopt a constitution in which encoding information such as the LPC coefficients, the pitch period, or the pitch gain is used in place of the frame mode in determining the bit rate.

If the quantized information of the LPC coefficients is used in the determination of the bit rate, the spectral envelope is calculated from the LPC coefficients after quantization, and the bit rate is determined from the size of the formants that indicate the spectral envelope. As a specific example, the spectral envelope energy for each pre-established sub-band is calculated, the sub-band having the maximum energy and the sub-band having the minimum energy are detected, and the ratio of the minimum value to the maximum value of the sub-band energy is determined. This ratio is compared with a threshold value and, if the ratio exceeds the threshold value, it is possible to treat the LPC coefficients as accurately representing the formants of the input signal, so that a combination of bit rates that has a low low-region encoding rate and high high-region encoding rate is selected. Conversely, if the ratio is at or below the threshold value, a combination of bit rates that has a high low-region encoding rate and a low high-region encoding rate is selected.

If the pitch period is used in the determination of the bit rate and if the time difference of the pitch period is smaller than a threshold value, it is possible to think that the prediction by the adaptive codebook or the pitch filter is being performed efficiently. For this reason, a combination of bit rates that has a low low-region encoding rate and a high high-region encoding rate is selected. Conversely, if the time difference of the pitch period at or above the threshold value, a combination of bit rates that has a high low-region encoding rate and a low high-region encoding rate is selected.

If the pitch gain is used in the determination of the bit rate, and if the size of the pitch gain is larger than a threshold value, it is possible to think that the prediction by the adaptive codebook or the pitch filter is being performed efficiently. For this reason, a combination of bit rates that has a low low-region encoding rate and a high high-region encoding rate is selected. Conversely, if the size of the pitch gain is at or below the threshold value, a combination of bit rates that has a high low-region encoding rate and a low high-region encoding rate is selected.

The foregoing has been a description of various embodiments of the present invention.

Although the foregoing descriptions use the example of G.718B, the present invention is not restricted to this manner. If an encoding system employs layer coding and multi rates in at least one of the layers, it is possible to obtain the effect of the present invention. Because the various embodiments have been described using G.718B that has a small number of bit rates, the effect of the present invention by switching the combinations of the low-region encoding rate and the high-region encoding rate described in Embodiment 1 is obtained for only the case of the overall bit rate of 40 kbit/s. However, for multi-rate encoding with a large number of bit rates, there are a large number of combinations of low-region encoding rates and high-region encoding rates for the same overall bit rate. In such cases, the effect of the present invention can be obtained to a greater degree.

FIG. 14 is a table showing specific examples of combinations of the low-region encoding rate and the high-region encoding rate. FIG. 14 shows the example in which a low-region encoding rate from 8 kbit/s to 20 kbit/s in steps of 2 kbit/s and a high-region encoding rate from 4 kbit/s to 16 kbit/s in steps of 2 kbit/s are supported. In FIG. 14, for example, when the overall bit rate is set to 24 kbit/s, there are seven combinations of low-region encoding rates and high-region encoding rates: {20, 4}, {18, 6}, {16, 8}, {14, 10}, {12, 12}, {10, 14}, and {8, 16}. Even if there are, as in this case, more than two combinations, the present invention can be applied.

Although the foregoing description is for the example of an encoding method that generates multiplexed data having scalability with respect to the signal bandwidth, the present invention is not restricted to this manner. Even in the case of an encoding system that generates multiplexed data having scalability with respect the bit rate, with the signal bandwidth held fixed, it is possible to obtain the effect of the present invention Additionally, although the foregoing description is of a method of determining the low-region encoding rate and the high-region bit rate based on the input signal feature, the present invention is not restricted to this manner. The low-region encoding rate and the high-region encoding rate may be determined based on calculated quantities of low-region signal encoding section 104 (501) and high-region signal encoding section 105. This is effective, for example, when, in a mobile telephone or mobile terminal, the encoding apparatus and the decoding apparatus described for the various embodiments operate by battery. Specifically, when the remaining battery life is short, a low-region encoding rate or a high-region encoding rate used for operating an encoding system that has a small amount of calculations is selected to thereby reduce electricity consumption. By determining the encoding rate based on the amount of calculations in this manner, it is possible to achieve a long operating time for a mobile telephone or mobile terminal.

Additionally, the present invention may have a constitution in which the low-region encoding rate is limited so that it does not become lower than a prescribed value. By doing this, it is possible to prevent a serious deterioration of the sound quality of the decoded low-region signal, and prevent a lowering of the sound quality.

Also, a constitution may be adopted that performs limitation so as to prevent extremely large time variations of the low-region encoding rate and the high-region encoding rate. For example, the amount of variation of the bit rate between frames is limited to a maximum of 2 kbit/s. In the example of FIG. 14, if the overall bit rate is set to 24 kbit/s, and the need arises to switch the combination of the low-region encoding rate and the high-region encoding rate from {20, 4} to {8, 16}, there is bit rate change of as much as 12 kbit/s between frames. In order to prevent such a sudden change in the combination of bit rate, the bit rate change can be limited so as to change by, for example, 2 kbit/s for each frame, going from {20, 4} to {18, 6}, and from {18, 6} to {16, 8}. In this case, the time of six frames is required to reach the ultimate bit rate combination of {8, 16}. By providing limitation so as to change the bit rates gradually in this manner, the change in sound quality between frames caused by a sudden change of the bit rate is minimized, enabling a reduction in the deterioration of the sound quality.

The present invention is not restricted to the foregoing embodiments, and may be subject to various modifications.

In the above embodiments, cases have been described by way of example in which the present invention is configured as hardware, but it is also possible for the present invention to be implemented by software.

Furthermore, each function block employed in the above descriptions of embodiments may typically be implemented as an LSI constituted by an integrated circuit. These may be implemented individually as single chips, or a single chip may incorporate some or all of the function blocks. "LSI" is adopted herein but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI production, utilization of an FPGA (Field Programmable Gate Array) or a reconfigurable processor where connections and settings of circuit cells in an LSI can be reconfigured may also be possible.

In the event of the introduction of a circuit implementation technology whereby LSI is replaced by a different technology, which is advanced in or derived from semiconductor technology, integration of the function blocks may of course be performed using technology therefrom. An application to biotechnology and/or the like is also possible.

The disclosures of specifications, the drawings, and the abstracts of Japanese Patent Application No. 2010-278228, filed on Dec. 14, 2010 and Japanese Patent Application No. 2011-084440, filed on Apr. 6, 2011 are incorporated herein by reference in their entirety.

INDUSTRIAL APPLICABILITY

The encoding apparatus, decoding apparatus, and the methods thereof of the present invention are suitable for use as an encoding apparatus or the like that encodes and decodes a speech signal and/or a music signal.

REFERENCE SIGNS LIST

100, 300, 500 Encoding apparatus
101 Feature analyzing section
102, 203, 301 Bit rate determining section
103 Down-sampling section
104, 501 Low-region signal encoding section
105 High-region signal encoding section
106, 515 Multiplexing section
107 RTP packet generating section
200, 400, 600 Decoding apparatus
201 RTP packet demultiplexing section
202, 611 Demultiplexing section
204, 601 Low-region signal decoding section
205 High-region signal decoding section
206 Up-sampling section
207 Decoded signal generating section
302 Redundant bit adding section
401 Redundant bit removing section
511 Frame mode discriminating section
512 Bit rate determining section
513 LPC coefficient encoding section
514 Excitation encoding section
515 Multiplexing section
612 Bit rate determining section
613 LPC coefficient decoding section
614 Excitation decoding section
615 Synthesis filter

The invention claimed is:

1. An encoding apparatus comprising:

a processor that analyzes an input signal feature for each of a low-region part and a high-region part of an input signal and that generates feature data that indicates analysis results of the input signal feature, and determines, based on a pre-set total encoding rate that is a total of a low-region encoding rate and a high-region encoding rate, and on the feature data, a combination of the low-region encoding rate and the high-region encoding rate;

a low-region encoder that encodes the low-region part of the input signal using the determined low-region encoding rate and generates low-region encoded data;

a high-region encoder that encodes the high-region part of the input signal using the determined high-region encoding rate and generates high-region encoded data; and a multiplexer that multiplexes the low-region encoded data, the high-region encoded data, and the feature data, wherein:

the processor adds a redundant bit to the multiplexed data in accordance with a difference between a total encoding rate of the determined combination and the pre-set total encoding rate, and the difference is calculated by subtracting one of the pre-set total encoding rate and the total encoding rate from other of the pre-set total encoding rate and the total encoding rate.

2. The encoding apparatus according to claim 1, wherein:

the processor takes results of a comparison between a threshold value and a difference between an energy level of the low-region part and an energy level of the high-region part as the feature data.

3. The encoding apparatus according to claim 1, wherein:

the processor takes, as the feature data, the results of a comparison between a threshold value and a LPC gain that is an energy ratio of the input signal to a LPC residue signal.

4. The encoding apparatus according to claim 1, wherein:

the processor restricts candidates of the combination, and determines the combination for actual use from among the candidates of the combination after the restriction.

5. The encoding apparatus according to claim 4, wherein:

if the feature data indicates that a large amount of a feature value, which is information included in common in the low-region part and the high-region part of the input signal, is included in the high-region part, the processor determines, from among the candidates of a combination having a lower total encoding rate than the pre-set total encoding rate, a combination for actual use having the higher high-region encoding rate than the low-region encoding rate.

6. A mobile station apparatus comprising the encoding apparatus according to claim 1.

7. A base station apparatus comprising the encoding apparatus according to claim 1.

8. A decoding apparatus comprising:

a demultiplexer that demultiplexes multiplexed data, in which low-region encoded data generated by encoding a low-region part of an input signal using a low-region encoding rate, high-region encoded data generated by encoding a high-region part of the input signal using a high-region encoding rate, and feature data indicating results of analysis of an input signal feature for each of the low-region part and the high-region part are multiplexed, into the low-region encoded data, the high-region encoded data, and the feature data;

a processor that determines, based on a pre-set total encoding rate that is a total of the low-region encoding rate and the high-region encoding rate and on the feature data, a combination of the low-region encoding rate and the high-region encoding rate;

a low-region decoder that decodes the low-region encoded data using the determined low-region encoding rate; and a high-region decoder that decodes the high-region encoded data using the determined high-region encoding rate, wherein:

the processor removes a redundant bit added to the multiplexed data in accordance with a difference between a total encoding rate of the determined combination and the pre-set total encoding rate, and the difference is calculated by subtracting one of the pre-set total encoding rate and the total encoding rate from other of the pre-set total encoding rate and the total encoding rate.

9. The decoding apparatus according to claim 8, wherein:

the processor restricts candidates of the combination, and determines the combination for actual use from among the candidates of the combination after the restriction.

10. The decoding apparatus according to claim 9, wherein:

if the feature data indicates that a large amount of a feature value that is information included in common in the low-region part and the high-region part of the input signal, is included in the high-region part, the processor determines, from among the candidates of a combination having a lower total encoding rate than the pre-set total encoding rate, a combination for actual use having the higher high-region encoding rate than the low-region encoding rate.

11. A mobile station apparatus comprising the decoding apparatus according to claim 8.

12. A base station apparatus comprising the decoding apparatus according to claim 8.

* * * * *